US010016797B2

(12) United States Patent
Vasi et al.

(10) Patent No.: US 10,016,797 B2
(45) Date of Patent: Jul. 10, 2018

(54) ROLLING UNIT

(71) Applicant: DANIELI & C. OFFICINE MECCANICHE SPA, Buttrio (IT)

(72) Inventors: Massimo Vasi, Udine (IT); Fabrizio Mulinaris, Udine (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 406 days.

(21) Appl. No.: 14/349,876

(22) PCT Filed: Oct. 8, 2012

(86) PCT No.: PCT/IB2012/001990

§ 371 (c)(1),
(2) Date: Apr. 4, 2014

(87) PCT Pub. No.: WO2013/050868

PCT Pub. Date: Apr. 11, 2013

(65) Prior Publication Data

US 2014/0238098 A1 Aug. 28, 2014

(30) Foreign Application Priority Data

Oct. 7, 2011 (IT) ..... UD2011A0158

(51) Int. Cl.
*B21B 31/26* (2006.01)
*B21B 13/00* (2006.01)
*B21B 1/18* (2006.01)

(52) U.S. Cl.
CPC ..... *B21B 31/26* (2013.01); *B21B 13/001* (2013.01); *B21B 1/18* (2013.01); *B21B 13/005* (2013.01)

(58) Field of Classification Search
CPC ..... B21B 31/20; B21B 31/203; B21B 31/24; B21B 31/26; B21B 31/28
(Continued)

(56) References Cited

U.S. PATENT DOCUMENTS 1,841,175 A * 1/1932 Fornelius ..... B21B 31/28 72/237
3,691,810 A * 9/1972 Tadeusz ..... B21B 13/147 101/218

(Continued)

FOREIGN PATENT DOCUMENTS

DE 2103734 A1 8/1972
EP 0752284 A1 1/1997

OTHER PUBLICATIONS

Int'l Search Report and Written Opinion dated Feb. 12, 2013 in Int'l Application No. PCT/IB2012/001990.

(Continued)

*Primary Examiner* — Teresa M Ekiert
*Assistant Examiner* — Gregory Swiatocha
(74) *Attorney, Agent, or Firm* — Panitch Schwarze Belisario & Nadel LLP

(57) ABSTRACT

Rolling unit including at least two adjacent rolling stands, each having a pair of rolling rolls mounted on respective motorized shafts. The rolls of one rolling stand are disposed orthogonal and close to those of the adjacent rolling stand. The shafts are eccentrically supported in respective support elements, which are selectively rotatable around their axis and are each provided with rotation means to cooperate mechanically with an adjustment member suitable to make the support elements selectively rotate to determine an adjustment of the gap between the rolls. The rotation means of one pair of the support elements are directly connected kinematically to each other. The adjustment member is disposed, with respect to the rolling stands, so that the center of its gear lies very close to the line joining the centers of the support elements, so that a substantial part is contained in the bulk defined by the rolling stand.

4 Claims, 4 Drawing Sheets

(58) Field of Classification Search
USPC ..... 72/248
See application file for complete search history.

(56) References Cited

U.S. PATENT DOCUMENTS

| | | | | | |
|---|---|---|---|---|---|
| 3,776,014 | A | | 12/1973 | Artz et al. | |
| 4,581,911 | A | * | 4/1986 | Shinomoto | B21B 13/005 72/237 |
| 5,655,424 | A | * | 8/1997 | Takeda | B21B 13/103 29/29 |
| 5,743,126 | A | * | 4/1998 | Shore | B21B 31/26 72/237 |
| 6,035,685 | A | * | 3/2000 | Takai | B21B 1/18 72/235 |

OTHER PUBLICATIONS

Int'l Preliminary Report on Patentability dated Jan. 3, 2014 in Int'l Application No. PCT/IB2012/001990.

* cited by examiner

ROLLING UNIT

CROSS-REFERENCE TO RELATED APPLICATION

This application is a Section 371 of International Application No. PCT/IB2012/001990, filed Oct. 8, 2012, which was published in the English language on Apr. 11, 2013, under International Publication No. WO 2013/050868 A1, and the disclosure of which is incorporated herein by reference.

FIELD OF THE INVENTION

The present invention concerns a rolling unit comprising a plurality of rolling stands disposed adjacent to each other and in sequence, each provided with a pair of rolling rolls whose reciprocal aperture is determined by an adjustment device.

In particular, the rolling unit according to the present invention allows to reduce the overall bulk and prevent the use of rolling guides between two adjacent rolling stands disposed in sequence.

BACKGROUND OF THE INVENTION

Rolling units are known, comprising rolling stands served by devices to adjust the gap between the rolls.

The device to adjust the gap allows to adjust their aperture and hence the section size of the rolled product to be obtained. Moreover, the adjustment device allows, for example after grinding operations, to re-use the rolling rolls whose diameter can vary as a function of the mechanical operations to which they have been subjected.

Each roll of a rolling stand is keyed to a shaft that is made to rotate in a known manner by drive members.

The pair of rolls in a rolling stand has the axes of rotation of the rolls disposed parallel to each other and orthogonal to the direction of rolling of the section shape.

The shafts supporting the rolls are supported by an eccentric bushing that is provided with a through hole in which each shaft of the rolls is housed.

The through hole of the eccentric bushing is made misaligned axially with respect to the longitudinal axis of the bushing. In this way, by making the eccentric bushing rotate, a variation is determined in the position of the axis of rotation of the shaft.

Each of the eccentric bushings is provided on the periphery with a toothing. The toothings of the eccentric bushings belonging to one pair of rolls engage in turn on a worm screw that is disposed in the inter-stand space of two adjacent rolling stands.

In particular, both the toothings of the eccentric bushings, when mounted, face with respect to a common side facing toward the stand upstream or the stand downstream of the rolling stand under consideration.

The worm screw is provided with a first threaded portion on which the toothing of one of the two rolls of the rolling stand engages, and with a second threaded portion that engages on the toothing of the other roll.

The first threaded portion and the second threaded portion respectively have a left-handed thread and a right-handed thread, or vice versa, so that when the worm screw is made to rotate, the toothings and hence the bushings are made to rotate in the same direction of rotation.

The eccentricity of the bushings entails that the axes of rotation of the rolls are reciprocally brought closer or distanced, and therefore entails an adjustment of the gap between the rolls.

The worm screw is disposed tangent with respect to both the toothed portions and between the rolling stand that is disposed upstream or respectively downstream with respect to the rolling stand under consideration.

The disposition of the worm screw in the intermediate space between two consecutive rolling stands entails an increase in the overall bulk of the rolling unit.

The bulk determines an increase in the distance between two adjacent rolling stands and it therefore becomes necessary to insert rolling guides for the rolled product being worked.

This entails an increase in the structural complexity of the rolling unit, and also an increase in the off-cuts of the head and tail ends of the product that is rolled.

Furthermore, even in the case where it is possible to reduce the overall bulk of the rolling unit in order to put the rolling stands adjacent to each other, the adjustment device is very expensive and complex to obtain.

In such cases, moreover, in order to further reduce the bulk between the rolling stands, the dimensional bulk of the inter-stand adjustment members is reduced, and the support structures thereof, that is, the worm screw. There is a consequent overall weakening of the bearing structure of the rolling unit and in particular of the bearing structure that supports the adjustment device.

Document DE 21 03 734 A1 describes a rolling stand with a system to adjust the gap between the rolls that consists of a worm screw that moves a pair of reciprocally engaging toothed wheels associated with the eccentric sleeve that supports a corresponding roll.

The position of the worm screw and the outermost toothed wheel determines an increase in the lateral bulk of the rolling stand, which does not allow to reduce the inter-stand space in the event of a close succession of stands in a rolling unit with two or more stands.

One purpose of the present invention is therefore to obtain a rolling unit that is extremely compact, simple and economical.

Another purpose of the present invention is to reduce the overall bulk of rolling machines, allowing a consequent reduction in the length of the works where the rolling plant is disposed.

Another purpose of the present invention is to obtain a rolling unit which does not require to use inter-stand guides to guide the section shape during rolling.

Another purpose of the present invention is to obtain a rolling unit that allows to further reduce rolling off-cuts of the head and tail ends of the products that are rolled.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes, a rolling unit according to the present invention comprises at least two rolling stands disposed adjacent to each other and in sequence in a direction of rolling, each provided with a pair of rolling rolls mounted on respective motorized shafts. The pair of rolls of one rolling stand is disposed with its axis orthogonal to those of the adjacent rolling stand, and in close reciprocal proximity.

The motorized support shafts of the rolls are in turn supported in the eccentric position by respective support elements.

The support elements are mounted on a bearing structure of the rolling stand, and are selectively rotatable around their axes. The possibility of being able to rotate the support elements eccentrically with respect to the axes of the motorized shafts allows to vary the reciprocal distance between the axes of the latter and hence to adjust the gap between the rolls of a rolling stand.

Furthermore, each of the support elements is associated with rotation or drawing means, which cooperate mechanically with an adjustment member that is suitable to make the support elements selectively rotate and hence to determine an adjustment of the gap between the rolls.

More particularly, some embodiments of the invention provide that the adjustment member comprises at least a gear and means to make said gear rotate, and said rotation or drawing means comprise at least a toothed member able to engage with the gear of the adjustment member to selectively make the support element rotate and hence vary the gap between the rolls.

According to some embodiments of the present invention, the toothed members of the support elements of the two rolls are kinematically connected to each other so that to a rotation of one of the support elements there corresponds an analogous rotation in the opposite direction of the other support element as well.

In this way, when the adjustment member makes one of the support elements rotate, it also determines a coinciding rotation of the other support element.

According to the present invention, the adjustment member is disposed with respect to the rolling stands so that the center of its gear lies along or very close to the line joining the centers of the toothed members of the support elements, so that a substantial part of the adjustment member is contained in the bulk defined by the rolling stand.

In this way it is possible to dispose the adjustment members in a space comprised in the inter-stand bulk, plan or lateral, depending on the type of stand, with rolls with a horizontal or vertical axis, of the first and second support element, preventing parts of the adjustment members from affecting the space between one stand and the next.

By center of the gear of the adjustment member we mean the center of rotation in which the axis of rotation passes if the gear is a toothed wheel or other rotating element.

If the gear has a different form, for example if it is a rack with a rectilinear development, the center will coincide with a position around the center line of the rack.

In any case, the adjustment member is disposed in a position substantially continuous in line with the development of the rolling stand. In other words, in the case of a stand with rolls with a horizontal axis, where an upper rolling roll is disposed above a lower rolling roll, the adjustment member will be disposed above or below the corresponding rolling stand. In the case of a stand with rolls with a vertical axis, where one rolling roll is disposed adjacent to the other rolling roll, the adjustment member will be disposed adjacent to the corresponding rolling stand.

This disposition of the adjustment member contained in the bulk of the rolling stand therefore allows to bring the rolling stands closer to each other, disposing the respective pairs of rolls substantially adjacent to each other, that is, distanced from each other by a distance substantially equal to, or a little more than, the diameter of the rolls. It is therefore possible to avoid inserting rolling guides between two adjacent rolling stands to guide the product being rolled, with a consequent simplicity of production and plant engineering. Furthermore, in this way it is possible to reduce the overall length of the rolling line, giving advantages in terms of spaces usable in the plant where it is installed.

It is also advantageous to provide that the toothed members are chosen from a group comprising a toothed crown and a toothed circular sector.

According to a variant embodiment, the support element on which the adjustment member acts is provided with a first toothed element and a second toothed element distinct and separate from the first.

The first and second toothed element are associated with each other so that to a rotation of the first element there corresponds an analogous rotation of the second toothed element. The adjustment member acts on the first toothed element of the support element, which makes the second toothed element rotate, which engages on a corresponding toothed element of the other support element to generate an analogous rotation on the other support element as well.

In one embodiment the first and/or the second toothed element comprise a toothed wheel or a toothed circular sector.

In one embodiment, the adjustment member comprises a worm screw which, when made to rotate, drives the corresponding gear of the adjustment member.

According to a variant, the adjustment member comprises a rack or another toothed wheel engaging with the gear.

The actuation of the worm screw, the rack, or the other toothed wheel can be obtained directly in either manual or motorized mode, or by introducing reducer members which allow to obtain a finer adjustment of the gap between the rolls, and also a reduction in the forces needed to obtain said adjustment.

DESCRIPTION OF THE DRAWINGS

These and other characteristics of the present invention will become apparent from the following description of a preferential form of embodiment, given as a non-restrictive example with reference to the attached drawings wherein.

Figure 1:
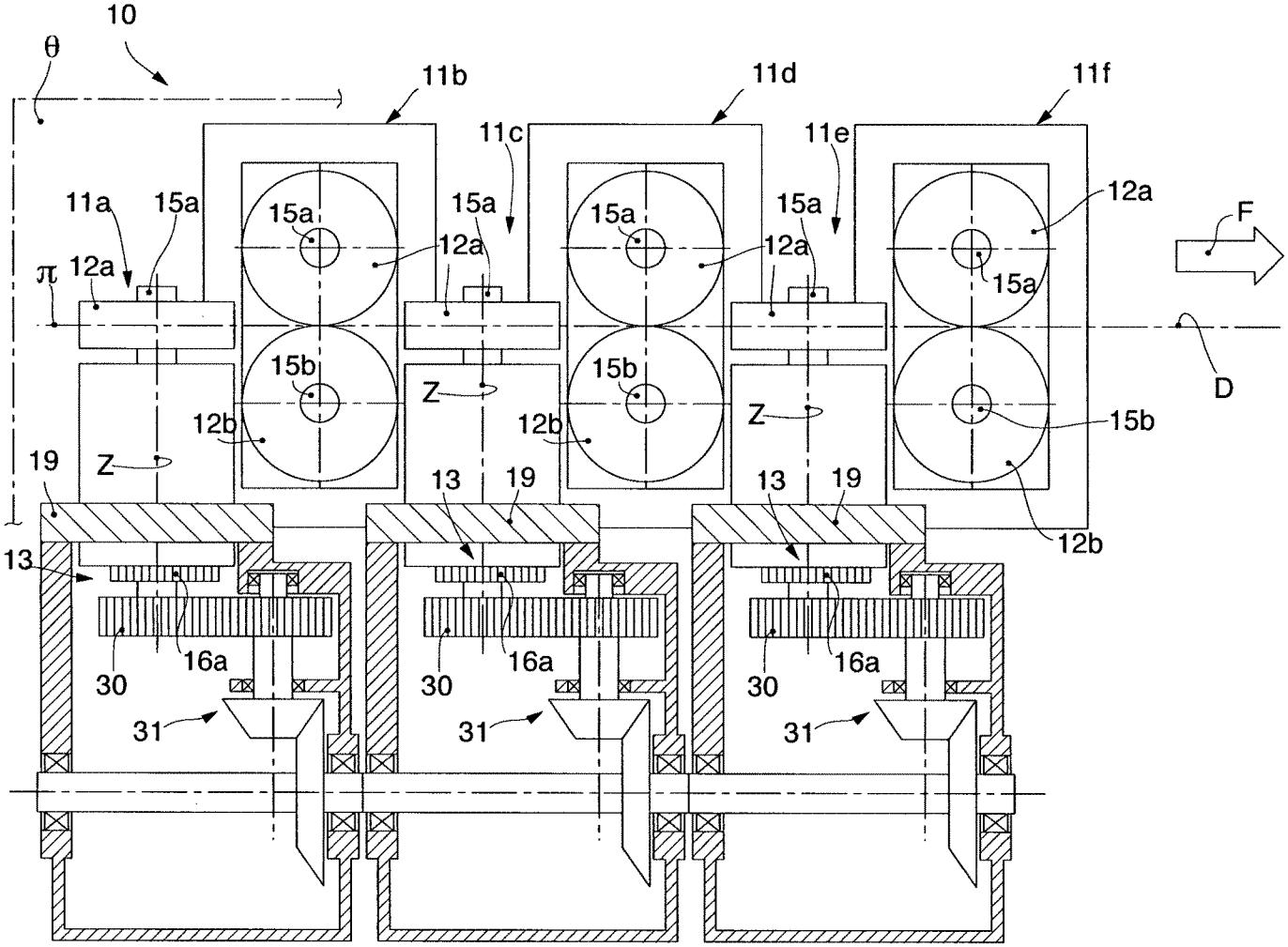
FIG. 1 is a schematic representation of a rolling unit according to the present invention.

To facilitate comprehension, the same reference numbers have been used, where possible, to identify identical common elements in the drawings. It is understood that elements and characteristics of one form of embodiment can conveniently be incorporated into other forms of embodiment without further clarifications.

DESCRIPTION OF SOME FORMS OF EMBODIMENT

With reference to FIG. 1, a rolling unit is denoted in its entirety by the reference number 10 and comprises a plurality of rolling stands 11*a*, 11*b*, 11*c*, 11*d*, 11*e*, 11*f*, each provided with a first rolling roll 12*a* and a second rolling roll 12*b*. Each rolling stand 11*a*, 11*b*, 11*c*, 11*d*, 11*e*, 11*f* comprises an adjustment device 13 to adjust the gap between the rolls 12*a*, 12*b* which allows to adjust the degree of aperture between the rolls and hence to vary the section sizes of the product that is rolled.

The pair of rolls 12*a*, 12*b* of the rolling stand 11*b* lies on a first lying plane π which is angularly offset by 90° with respect to a second lying plane θ on which lie the pair of rolls 12*a*, 12*b* of the rolling stands 11*a* and 11*c* disposed respectively upstream and downstream of the rolling stand 11*b*. An analogous disposition of the rolls 12*a*, 12*b* also applies for the other rolling stands 11*c*, 11*d*, 11*e* and 11*f*.

Between the rolling rolls 12*a*, 12*b* a product to be rolled is made to pass, for example a bar or wire, which advances along the rolling axis D, in the direction indicated by the arrow F.

Figure 2:
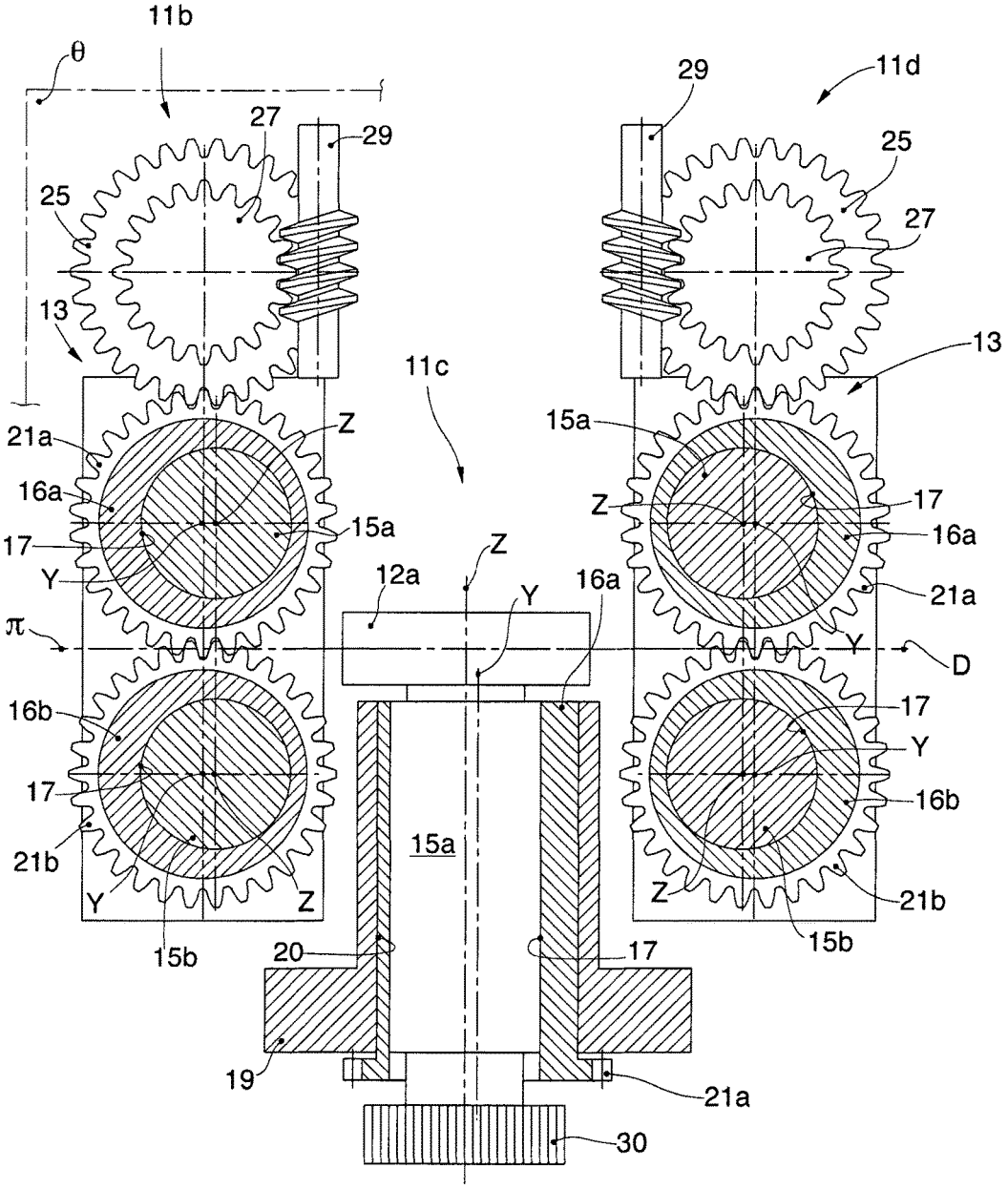
FIG. 2 is a sectioned view of a part of FIG. 1.

Each first 12*a* and second roll 12*b* (FIGS. 2-4) of each rolling stand 11*a*, 11*b*, 11*c*, 11*d*, 11*e*, 11*f* is keyed cantilevered on a shaft 15*a*, respectively 15*b*, each having an axis of rotation Z.

The axes of rotation Z of the first shaft 15*a* and second shaft 15*b* are disposed on a first plane A of common lying.

The first and second shaft 15*a*, 15*b* of the first 12*a* and second roll 12*b* have their axes of rotation Z disposed substantially parallel to each other, and orthogonal with respect to the rolling axis D.

Each shaft 15*a*, 15*b* (FIG. 2) is mounted on a support element, in this case an eccentric bushing 16*a*, respectively 16*b*, provided with a through hole 17 in which the shaft 15*a*, 15*b* supporting the rolls 12*a* 12*b* is housed.

More specifically, a first eccentric bushing 16*a* supports the first shaft 15*a* to which the first roll 12*a* is associated, while a second eccentric bushing 16*b* supports the second shaft 15*b* to which the second roll 12*b* is associated.

The through hole 17 has its axis offset axially with respect to the longitudinal axis of the eccentric bushing 16*a*, 16*b*, so that an eccentricity is obtained between the eccentric bushing 16*a*, 16*b* and the shaft 15*a*, 15*b*.

The eccentric bushing 16*a*, 16*b* (FIG. 2) is housed in a support structure 19 provided with a housing hole 20 and can rotate around an axis Y which is offset with respect to the axis Z.

Each of the eccentric bushings 16*a*, 16*b* (FIG. 4) is provided, at one end and on its external surface, with rotation means comprising respective toothed members 21*a*, 21*b*, e.g. a toothed crown 21*a* and respectively 21*b*.

In particular, the toothed crowns 21*a*, 21*b* are of such a size, and are mounted on the support structure 19 in such a way, that they engage reciprocally with each other so that a rotation of one also causes the other to rotate.

Figure 3:
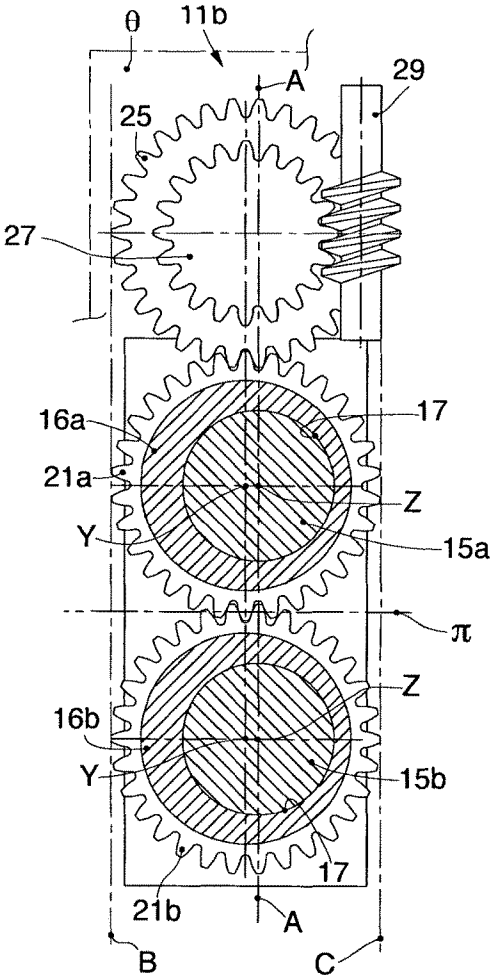
FIG. 3 is a view of a detail of FIG. 2.

Each of the eccentric bushings 16*a*, 16*b* of the first 15*a* and second shaft 15*b* have an inter-stand bulk comprised between a second plane B and a third plane C (FIG. 3). The second plane B and the third plane C are both parallel to the first plane A on which the axes of rotation Z of the first 15*a* and second shaft 15*b* lie.

The adjustment device 13 comprises an adjustment member comprising at least a gear, e.g. a first adjustment or engagement toothed wheel 25, which acts directly on the toothed crown 21*a* of the first support element 16*a*.

Means are associated with the first toothed wheel 25 to make it rotate, so as to determine an adjustment of the gap between the rolls 12*a*, 12*b*.

In other embodiments, the adjustment member may also comprise a toothed circular sector, a rack or a worm screw.

With reference to FIG. 3, the first toothed wheel 25 acts in the space comprised between the second B and the third plane C described above, and is disposed so as to always intersect the first plane A of lying. In other words, the first toothed wheel 25 is disposed so that at least a substantial part thereof is contained in the bulk defined by the rolling stand 11*a*, 11*b*, 11*c*, 11*d*, 11*e*, 11*f*, that is, between the second B and third plane C.

In particular, the center of the first toothed wheel 25 substantially lies along, or very close to, the line joining the centers of the toothed crowns 21*a* and 21*b*, so that the whole adjustment device 13 is disposed continuous in line with the development of the corresponding rolling stand 11*a*, 11*b*, 11*c*, 11*d*, 11*e*, 11*f*.

With this particular configuration, the adjustment device 13 is disposed so as not to occupy the inter-stand space and therefore not to generate an increase in the bulk between the rolling stands 11*a*, 11*b*, 11*c*, 11*d*, 11*e*, 11*f*, in order to overcome the disadvantages of the state of the art.

It is advantageous to provide that the first toothed wheel 25 acts tangentially to the first toothed crown 21*a* and substantially in correspondence to the intersection with a plane on which the axes Y of the eccentric bushings 16*a*, 16*b* lie.

Figure 4:
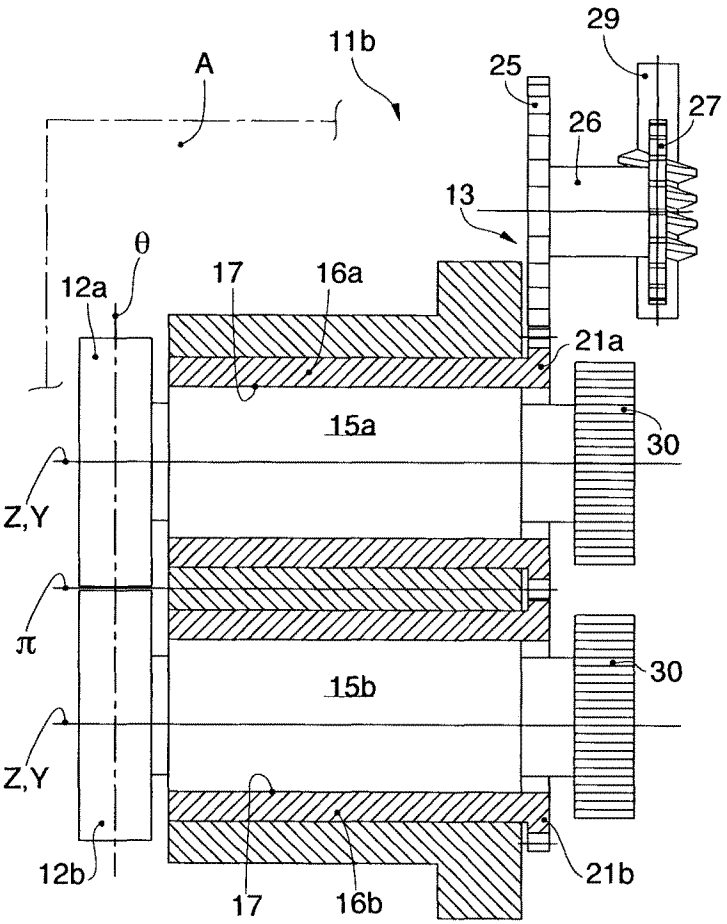
FIG. 4 is a lateral view of FIG. 3.

The first toothed wheel 25 is keyed on a shaft 26 (FIG. 4). At the opposite end of the shaft 26 with respect to where the first toothed wheel 25 is mounted, a second toothed wheel 27 is keyed, which in turn engages on a worm screw 29 (FIGS. 2-4), selectively rotatable either manually or by means of suitable motorized actuation members selectively actuated by the user.

In particular, by making the worm screw 29 rotate, a rotation is determined of the second toothed wheel 27 which, since it is solidly associated with the shaft 26, entails an analogous rotation of the first toothed wheel 25 as well.

The rotation of the first toothed wheel 25 determines a consequent rotation of the first eccentric bushing 16*a* as well, and hence also of the second eccentric bushing 16*b*, since, in order, the first toothed wheel 25, the first toothed crown 21*a* and the second toothed crown 21*b* are reciprocally engaging with each other.

The conformation of the eccentric bushings 16*a*, 16*b* is such that a rotation thereof entails a variation in the position of the shafts 15*a* and 15*b*, that is, a variation in the reciprocal distance of the axes Z to determine a consequent variation in the gap comprised between the first roll 12*a* and the second roll 12*b*.

More specifically, the distance between the axis of rotation Z and the axis Y of the eccentric bushings 16*a*, 16*b* determines the amplitude of adjustment of the gap between rolls 12*a*, 12*b*. In fact, the variation in the gap between the rolls that can be determined can be as much as double the distance of the axis of rotation Z and the axis Y.

In other embodiments, it may be provided that, instead of being a toothed wheel 25 as described above, the adjustment member is an analogous mechanical member suitable to make the first eccentric bushing 16*a* rotate, for example it may be provided to use a rack that acts tangentially to the first toothed crown 21*a* and which is disposed so as to always intersect the first plane A containing the axes of rotation Z of the shafts 15*a*, 15*b*. In this case, the term "center" is taken to mean a substantially median zone on the length of the rack.

In this case the movement of the rack can be obtained by means of linear actuation members possibly also associated with lever mechanisms.

In still other embodiments, the first toothed wheel 25 can be directly associated with actuation means, both manual and motorized, without providing the use of the second toothed wheel 27 and the worm screw 29.

A reducer member may be associated to the worm screw 29, selectively actuated in manual or motorized mode. The reducer member associated to the worm screw 29 allows to achieve a very precise adjustment of the gap between the rolls.

A toothed wheel 30 or mandrel is solidly associated to each of the first 15*a* and second shafts 15*b*, at the opposite end to that where the first 12*a* and second roll 12*b* are keyed.

An actuation mechanism 31 (FIG. 1), possibly provided with means to reduce the revolutions, is associated to the toothed wheel 30 and is provided to make both shafts 15*a*, 15*b* rotate, and hence the rolls 12*a*, 12*b*, in order to roll the rolled product.

Figure 5:
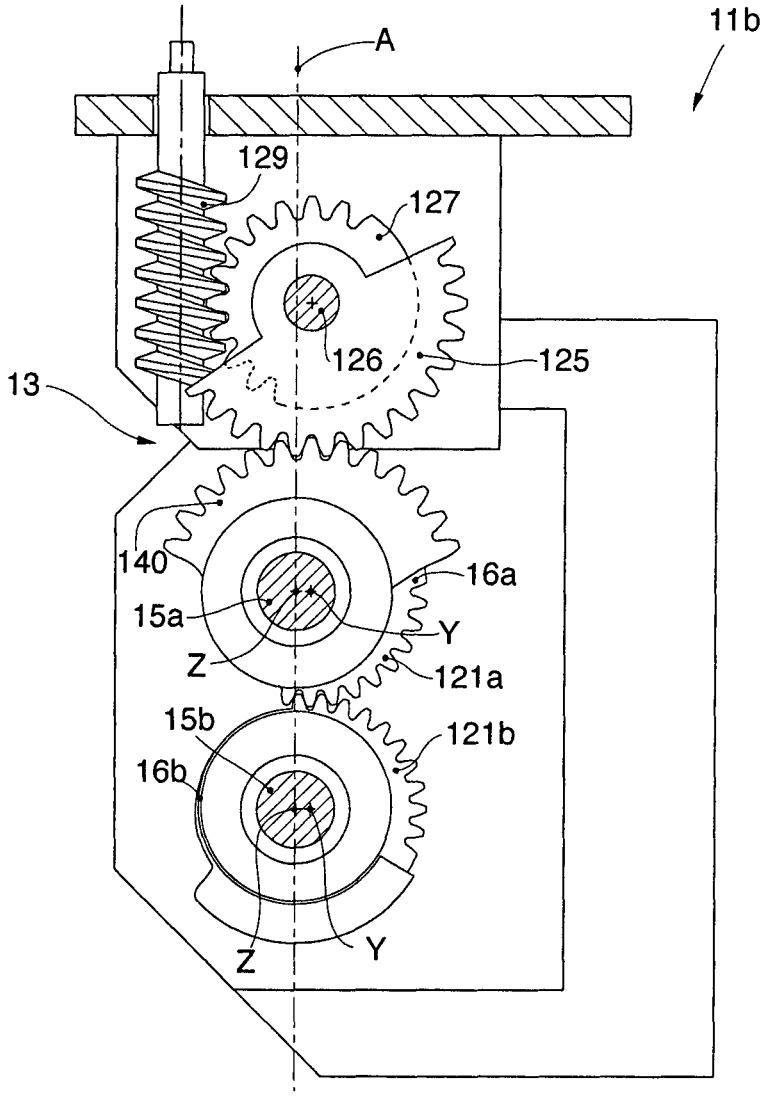
FIG. 5 is a view of a variant of FIG. 3.

According to another embodiment shown in FIG. 5, the rolling stands, in this case the rolling stand 11*b*, instead of comprising eccentric bushings 16*a* and 16*b* provided with a toothed crown extending for the whole circumference, are provided only with a toothed portion or element, or toothed sector, e.g. a toothed circular sector, respectively 121*a*, 121*b*, which extends angularly for an angle equal to or slightly more than 90°.

The toothed portions 121*a*, 121*b* reciprocally engage with each other and rotate around the axis Y which is offset with respect to the axis Z of the shafts 15*a* and 15*b* in order to determine the desired eccentricity.

The eccentric bushing 16*a* is in turn provided with another toothed portion or element 140 having the same or different dimensional geometric characteristics as/from the toothing of the toothed portion 121*a*.

Furthermore, instead of providing to use the first toothed wheel 25 and the second toothed wheel 27 as described above, the adjustment device 13 is provided with a first toothed sector 125 that in turn engages on the toothed portion 140 of the first bushing 16*a*, and with a second toothed sector 127 that is provided to engage with a worm screw 129 or, in other embodiments, with other mechanical members such as for example a rack. The first toothed sector 125 and the second toothed sector 127 are made to rotate together, since both are mounted solid with a single shaft 126.

By making the worm screw 129 rotate, either manually or with motorized actuation members, the rotation is determined of the second toothed sector 127 and the first toothed sector 125.

The rotation of the first toothed sector 125 determines the rotation of the toothed portion 140 associated with the eccentric bushing 16*a* and hence the consequent rotation also of the toothed portion 121*a* solidly associated with the latter.

The rotation of the toothed portion 121*a* also determines the consequent rotation of the eccentric bushing 16*b*, and therefore a consequent adjustment of the gap between the rolls 12*a* and 12*b*.

In this embodiment too the adjustment device 13 acts only on the eccentric bushing 16*a* and is disposed so as to directly intersect the first plane A on which the axes of rotation Z of the first 15*a* and second shaft 15*b* lie.

The angular amplitude of the toothed portion 140, of the first toothed sector 125 and of the second toothed sector 127, and also their reciprocal disposition with respect to the respective axes of rotation is such as to allow the rotation of the eccentric bushings 16*a*, 16*b* and to determine the variation in the reciprocal gap between the rolls 12*a*, 12*b* from their minimum value to their maximum value.

It is clear that modifications and/or additions of parts may be made to the rolling unit as described heretofore, without departing from the field and scope of the present invention.

For example, it may be provided that, instead of supporting directly the shafts 15*a*, 15*b* of the rolls 12*a*, 12*b*, the eccentric bushings 16*a*, 16*b* are provided with circular seatings, made eccentric with respect to the axis of longitudinal development of the eccentric bushings 16*a*, 16*b*, in which rolling elements can be housed, such as for example bearings.

Furthermore, it may be provided that, with reference to the description regarding FIG. 5, the first toothed sector 125 and the second toothed sector 127 may be replaced by a toothed wheel which performs the same function.

It is also clear that, although the present invention has been described with reference to some specific examples, a person of skill in the art shall certainly be able to achieve many other equivalent forms of rolling unit, having the characteristics as set forth in the claims and hence all coming within the field of protection defined thereby.

The invention claimed is:

1. Rolling unit comprising:

at least two rolling stands (11*a*, 11*b*, 11*c*, 11*d*, 11*e*, 11*f*) disposed adjacent to each other and each provided with a pair of rolling rolls (12*a*, 12*b*) defining a rolling axis (D), mounted on respective first and second motorized shafts (15*a*, 15*b*), wherein rotation axes (Z) of the first and second motorized shafts (15*a*, 15*b*) are disposed on a first plane (A) of common laying, and wherein said rotation axes (Z) of said first and second motorized shafts (15*a*, 15*b*) are disposed substantially parallel to each other, and orthogonal with respect to said rolling axis (D), said pair of rolling rolls of one rolling stand being disposed orthogonal with respect to those of the adjacent rolling stand, said first and second motorized shafts (15*a*, 15*b*) being supported in an eccentric position with respect to the respective rotation axes (Z) in respective support elements (16*a*, 16*b*), said each support element (16*a*, 16*b*) being selectively rotatable around an axis of the support element and each support element being provided with a toothed member (21*a*, 21*b*, 121*a*, 121*b*), the toothed member of one support element reciprocally and directly engaging the toothed member of the other support element such that rotation of one toothed member causes rotation of the other toothed member, each toothed member being suitable to cooperate mechanically with an adjustment member suitable to make said support elements (16*a*, 16*b*) selectively rotate and determine an adjustment of a gap between said rolls (12*a*, 12*b*), each adjustment member comprising one gear (25; 125) and a means to make said gear (25; 125) rotate, and the toothed member (21*a*, 21*b*; 121*a*, 121*b*) of only one of the support elements (16*a*, 16*b*) being able to engage with the gear (25; 125) of the adjustment member in order to selectively make said support elements (16*a*, 16*b*) rotate and therefore vary the gap between the rolls (12*a*, 12*b*), wherein each of said support elements (16*a*, 16*b*) has a bulk defined by a second plane (B) and a third plane (C) which are both parallel to said first plane (A) and disposed on opposite sides of said first plane (A), each of the second plane (B) and the third plane (C) intersecting and being tangential to at least one of the support elements (16*a*, 16*b*), wherein each adjustment member is disposed, with respect to each rolling stand (11*a*, 11*b*, 11*c*, 11*d*, 11*e*, 11*f*), so that a center of its gear (25; 125) lies along, or very close to, a line joining centers of the toothed members (21*a*, 21*b*; 121*a*, 121*b*) of the support elements (16*a*, 16*b*) so that a part of the adjustment member is contained in a bulk defined by each rolling stand (11*a*, 11*b*, 11*c*, 11*d*, 11*e*, 11*f*), wherein each gear is a first toothed wheel or sector (25; 125), wherein each adjustment member further comprises a second toothed wheel or sector (27, 127) keyed on a same shaft (26, 126) on which said first toothed wheel or sector (25, 125) is keyed and a worm screw (29, 129) meshed with said second toothed wheel (27, 127), and wherein each first toothed wheel or sector (25, 125) acts in a space comprised between said second plane (B) and said third plane (C), and is disposed so as to always intersect said first plane (A).

2. Rolling unit as in claim 1, wherein said toothed members are chosen from a group comprising a toothed crown (21*a*, 21*b*) and a toothed sector (121*a*, 121*b*).

3. Rolling unit as in claim 1, wherein the support element (16*a*) on which said first toothed wheel or sector (125) acts is provided with a first toothed element (140), kinematically coupled with said gear (125), and with a second toothed element (121*a*) distinct and separate from the first toothed element (140) and rotatable with it.

4. Rolling unit as in claim 3, wherein at least one of either the first toothed element (140) or the second toothed element (121*a*) comprises a toothed circular sector.

* * * * *